United States Patent [19]

Reed

[11] Patent Number: 4,931,700

[45] Date of Patent: Jun. 5, 1990

[54] ELECTRON BEAM GUN

[76] Inventor: Jay L. Reed, 1015 Silcox Branch Cir., Oviedo, Fla. 32765

[21] Appl. No.: 239,681

[22] Filed: Sep. 2, 1988

[51] Int. Cl.[5] ..... H01J 29/48

[52] U.S. Cl. ..... 315/111.81; 315/111.01; 313/230; 313/231.01

[58] Field of Search ..... 315/111.81, 111.91, 315/111.01; 313/230, 231.01; 250/492.3, 423 R

[56] References Cited

U.S. PATENT DOCUMENTS

| | | | |
|---|---|---|---|
| 4,240,005 | 12/1980 | Keller | 313/231.01 |
| 4,422,013 | 12/1983 | Turchi et al. | 315/111.81 |
| 4,426,597 | 1/1984 | Denoyer et al. | 315/111.81 X |
| 4,563,608 | 1/1986 | Lawson et al. | 313/231.01 X |

*Primary Examiner*—Eugene R. LaRoche
*Assistant Examiner*—Do Hyun Yoo
*Attorney, Agent, or Firm*—MacDonald J. Wiggins

[57] ABSTRACT

A cold cathode electron gun utilizes a metallic torus for electrostatic focusing of an electron beam. A nonconductive tube is disposed within and along the axis of the torus. A conductive aerodynamic body electrically connected to the torus forms an annular venturi in the tube and includes a face which serves as a high field emitting surface. High molecular weight gas is introduced into a proximal end of the tube at a stagnation pressure sufficient to produce supersonic flow thereby causing a vacuous gas region adjacent the emitting surface. The torus and emitting surface are driven to a very high negative potential by a Tesla transformer or the like, producing high field emission into the vacuous region. The electric field of the torus produces, from the emitted electrons, an electron beam which issues from the tube into the atmosphere.

8 Claims, 4 Drawing Sheets

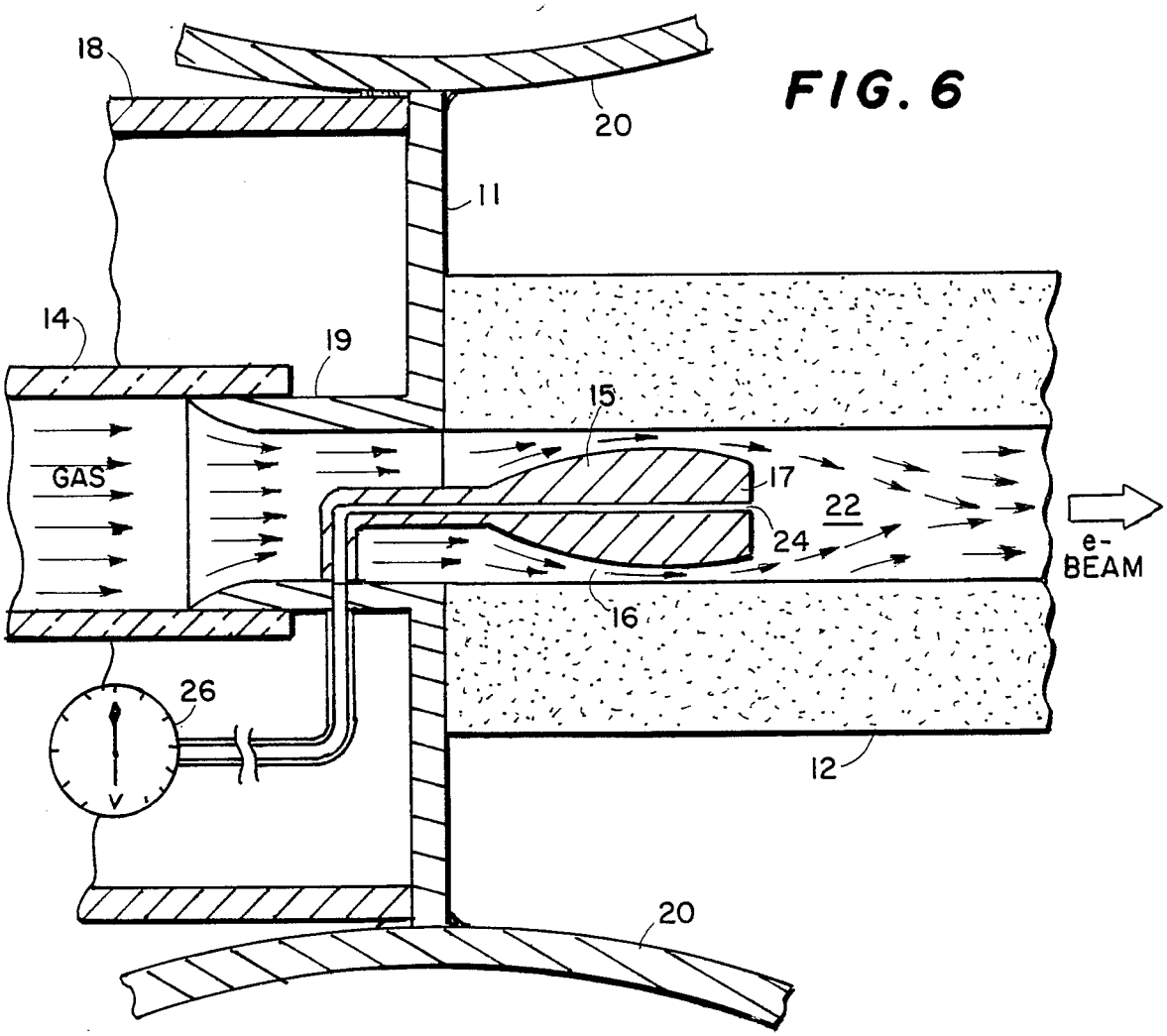
FIG. 6
FIG. 7
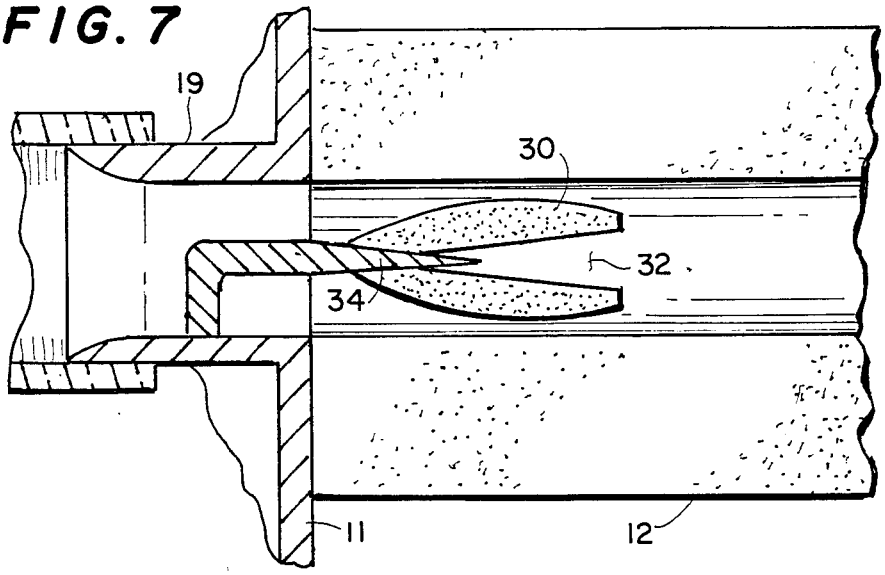

ELECTRON BEAM GUN

BACKGROUND OF THE INVENTION

1. Field of the Invention

The present invention relates to intense relativistic electron beams, and more particularly to an improved cold-cathode electron gun that does not require an evacuated envelope.

2. Description of the Prior Art

Relativistic electron beams have a variety of commercial, scientific and military applications. High power electron guns provide a source of particulate radiation for industrial radiography, chemical polymerization, sterilization of food and drugs, and directed energy concepts. Prior art methods of generating high power electron beams have been described in Winterberg, F. "The Potential of Electric Cloud Modification by Intense Relativistic Electron Beams", *Zeitschift fuer Meteorolgie,* 25, No. 3,180 (1975). A self-accelerated cold-cathode electron gun described therein uses an evacuated dielectric tube containing the cathode emitter spaced from a grounded titanium foil that seals the tube end. The gun is excited as the load of a Marx electric surge generator. During the application of a high voltage surge, electrons are released from the cathode material by cold-field emission, due to the high electric field at the cathode face. The electrons accelerate toward the foil window and, if their energy is sufficiently high, penetrate into the open air.

When this type of gun is used to produce high power beams, the foil window is vaporized by energy deposition and the gun is destroyed. The presence of the grounded foil also limits the voltage that can be applied to the cathode without flashover occurring to the grounded window. Additionally, the closed evacuated system must be provided with means to limit the hardening of the gun's vacuum due to the interaction of the residual gas and electron beam. The hardening produces unwanted variations in the gun's electrical impedance.

Winterberg also describes a workpiece-accelerated cold-cathode electron gun that does not require a physical window but develops the beam in a vacuum and directs the beam into the air via a fractional vacuum gate. It is necessary to pump the gate and provide auxiliary magnetic fields to guide the beam through the gate.

The gun designs discussed by Winterberg suffer from an accumulation of heat at the cathode electrode and dielectric gun barrel, which if not removed leads to wear and destruction of the gun.

The projection of intense relativistic electron beams into the free atmosphere requires a gun that can support very high power levels and be fired at a high repetitive rate. The gun should be free from physical windows, auxiliary magnetic fields, drive voltage limitations due to cathode-anode spacing, self-destruction due to heating, and vacuum hardening.

SUMMARY OF THE INVENTION

The present invention is a workpiece- accelerated, cold-cathode electron gun that supports a high power level by not requiring an evacuated envelope. The gun may be driven from any power supply of sufficiently high voltage; a Tesla transformer is preferred as it is capable of supplying surges of very high power at high repetition rates.

The gun includes a metallic torus used as an electrostatic insulator. The torus has a metallic web across its central opening which supports a dielectric ceramic tube projecting therefrom. A long metallic tube connects to a proximal end of the ceramic tube and is electrically connected to the high voltage output terminal of the Tesla transformer with the other terminal grounded to earth. A gas hose concentric with the connection tube is connected to a dry gas source.

A metallic aerodynamic body is supported within the bore of the ceramic tube to form a convergent-divergent annular venturi and is electrically connected to the torus and connection tube. A flat front face of the aerodynamic body serves as the cold cathode emission surface. The dry gas has a high molecular weight and is introduced into the proximal end of the ceramic tube at a stagnation pressure sufficient to produce supersonic flow beyond the venturi throat. The high mach number annular jet creates a vacuous gas region adjacent to the cathode face and extending toward the distal end of the ceramic tube bore.

When a high voltage surge is applied by the Tesla transformer, driving the torus and cathode electrode to a large negative voltage, the electric field at the face of the cathode becomes so great that cold field emission of electrons occurs. The released electrons are given a preferential direction of discharge normal to the face of the cathode, along the torus axis of symmetry. The electrons are accelerated through the vacuous region by the electric field of the cathode, and pass into the open air to the grounded workpiece. The cathode electrode and ceramic tube undergo an intense cooling due to the Joule-Thomson effect of the expanding flow. Additionally, the high velocity gas stream clears the gun of beam conduction products and reduces the time required to regain its normal electrical impedance.

As will now be recognized, a novel electron gun has been disclosed which eliminates a physical interface between the electron emitter and open air, and whose performance is not limited by electrode spacings, sealed envelopes, or heat accumulation.

It is therefore a principal object of the invention to provide a workpiece accelerated cold-field emission electron gun in which a vacuum adjacent to an emitting surface is formed by a supersonic gas flow over an aerodynamic body, and a focused electron beam passes from the vacuum into the air without a physical interface.

It is another object of the invention to provide cold field emission of electrons using electrostatic focusing, and a flow of dry gas through a convergent-divergent venturi to achieve a vacuous space adjacent to the emission surface.

It is still another object of the invention to provide an electron gun having no physical interface between an emitting surface and the air in which a high electric field at the emitting surface is produced by a Tesla transformer and an insulating electric field along the beam is produced by a metallic torus.

These and other objects and advantages of the invention will become apparent from the following detailed description when read in conjunction with the drawings.

BRIEF DESCRIPTION OF THE DRAWINGS

FIG. 6 is a cross sectional view of the gun portion of the invention; and

FIG. 7 is a cross sectional view of an alternative cathode electrode design of the gun portion of the invention.

DETAILED DESCRIPTION OF THE PREFERRED EMBODIMENT

Figure 1:
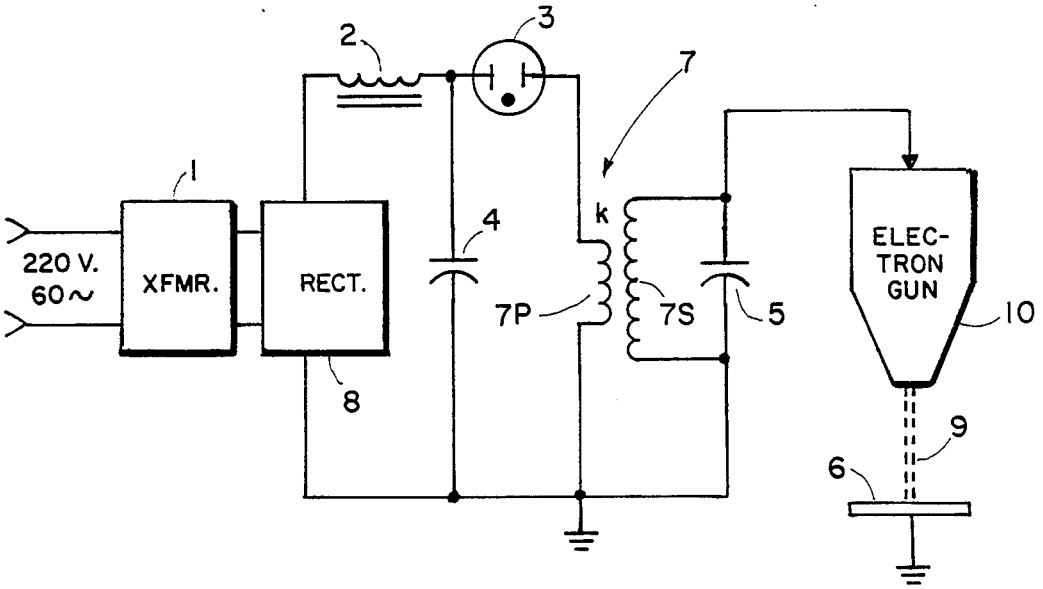
FIG. 1 is a schematic diagram of a Tesla transformer system for supplying power to the invention.

The electron gun 10 of the invention is indicated schematically in FIG. 1 in which an electron beam 9 impinges on workpiece 6. As will be understood, gun 10 may be excited by any source of sufficiently high voltage. However, a preferred source is a Tesla transformer as shown schematically in FIG. 1. A high voltage supply transformer 1, powered from the commercial mains, with an output voltage of 15 to 80 kilovolts is suitable for exciting Tesla transformer 7 and gun 10. The output of transformer 1, is rectified by full wave bridge rectifier 8.

Figure 2:
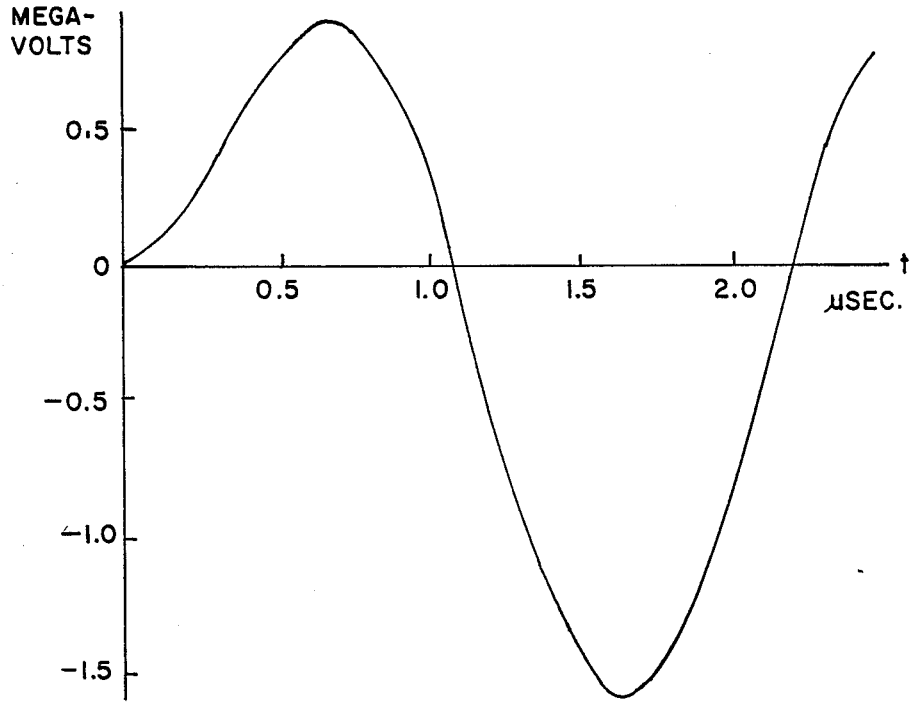
FIG. 2 is a typical waveform of the primary of the Tesla transformer of FIG. 1.

Tesla transformer 7 includes a small primary inductance 7P coupled to a large secondary inductance 7S. The resistance of both windings should be as low as practical. The coefficient of coupling k is selected along with the values of primary capacitance and winding inductances to produce an optimum voltage gain as is known in the art. The fully rectified and unfiltered current from transformer 1 charges primary capacitor 4 via charging inductor 2 which isolates oscillations in the Tesla transformer from the mains. Transformer 1 is impedance matched to the primary capacitor 4 at the mains frequency, known in the art as ac-resonant charging. As will be noted, a spark gap switch 3 is connected between the primary inductance 7P and primary capacitor 4. The spark gap switch is adjusted to selfbreakdown at the voltage obtained on the primary capacitor 4 at full charge. When the primary capacitor 4 is fully charged, the spark gap switch 3 conducts and commutates the primary capacitor energy into the primary inductance. The Tesla transformer 7 executes an oscillation and transfers the primary capacitor energy into the relatively small capacity of the secondary circuit. The capacity of the secondary circuit consists of the distributed capacity 5 of the secondary inductance in parallel with the electrostatic capacity of the electron gun. The resulting voltage gain is substantially equal to the square root of the quotient of the primary capacitance and the secondary capacitance. Voltage gains of 15 to 40 are commonly achieved in practice. The peak voltage applied to the electron gun is the product of the voltage gain and voltage on the primary capacitor at the instant of commutation. For purposes of explanation, a high voltage supply transformer rated at 50 kilovolts and a Tesla transformer with a voltage gain of 31.25, producing a 1.5 megavolt surge will be assumed to be applied to the electron gun. FIG. 2 shows the voltage history of such output surge. Near the peak of the negative going portion of the surge, cold field emission will occur as will be described hereinbelow, and electron beam 9 will be discharged to grounded workpiece 6. As the primary capacitor is fully charged and discharged at twice the frequency of the commercial mains, the Tesla transformer accelerator system will emit 120 beams per second. Thus, the preferred power supply generates a sequence of high power beams at a repetition rate controlled by the frequency of the supply mains.

Although a Tesla transformer has been used as an example of a suitable power source, other types of suitable sources will be familiar to those of skill in the art.

Figure 3:
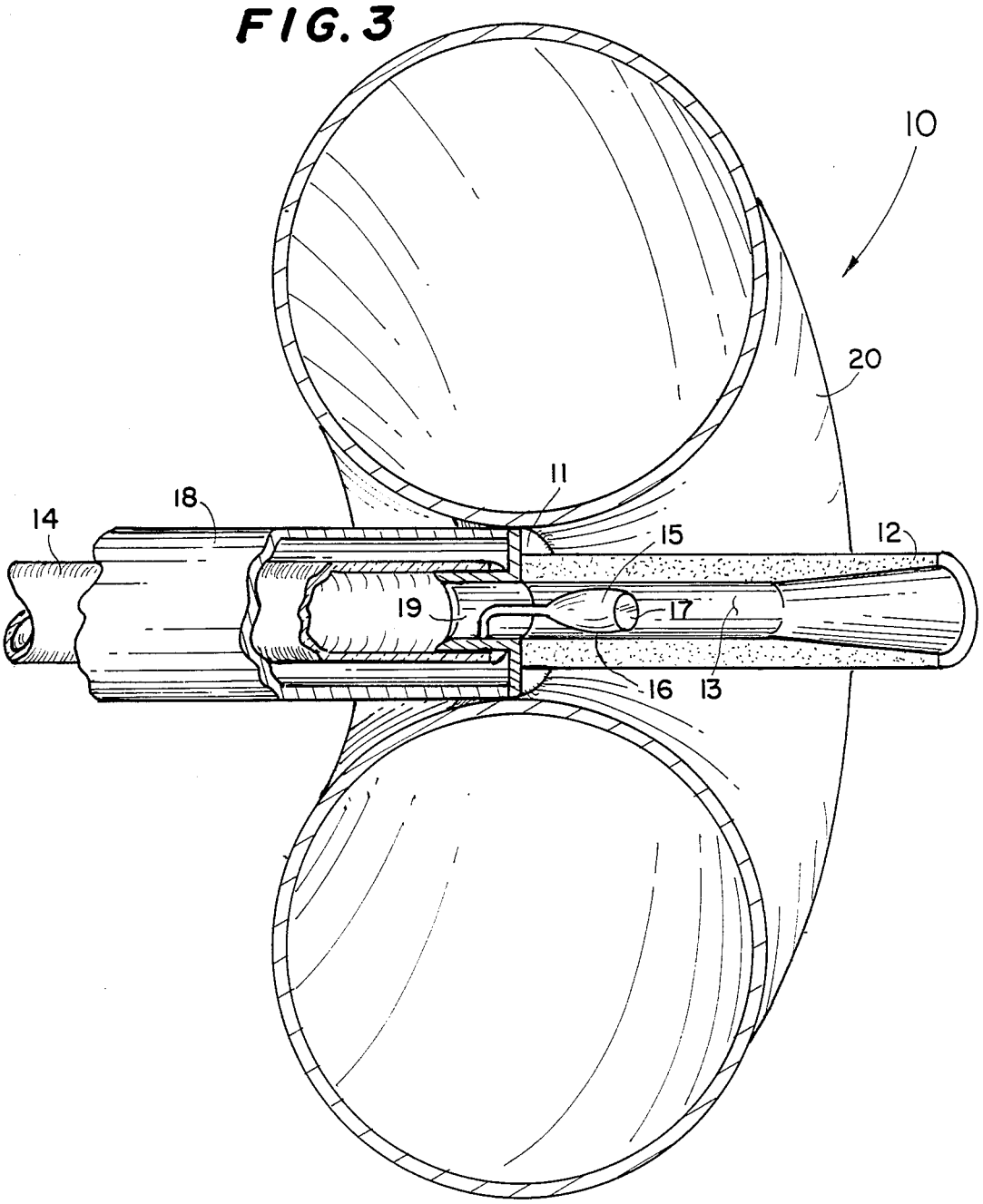
FIG. 3 is a perspective view of the electron beam gun of the invention with portions thereof in cross section.

Having described the function of electron gun 10, the construction thereof will be described with reference to FIG. 3 in which a perspective view of a preferred embodiment is shown. The operative portions of gun 10 are shown in cross section. A hollow metallic torus 20 is provided as an electrostatic insulator. Torus 20 functions on the principle of a corona ring as will be discussed below. A web 11 is attached in the central opening of torus 20 and supports a conductive metal connecting tube 18 along the torus axis. Tube 18 serves to connect torus 20 to the output of Tesla transformer 7. A ceramic tube 12 is bonded at its proximal end to web 11 and projects normal to the plane of torus 20 along its axis. Ceramic tube 12 is slightly flared at its distal end. Ceramic tube 12 is formed from a material having a low dielectric constant such as machinable glass, fused quartz, or the like. A cathode electrode 15 having a flat face 17 is suspended and centered in bore 13 of ceramic tube 12. Cathode 15 may be formed from Elkonite(®), available from P.R. Mallory Co., or like materials. The body of cathode 15 forms a shock-free, convergent-divergent annular venturi 16 within ceramic tube 12. As will be noted, cathode 15 is concentric with the central opening of torus 20.

Cathode 15 is supported by and electrically connected to a metallic hose fitting portion 19 of web 11. A gas supply hose 14 is attached to hose fitting portion 19 and is essentially concentric with connecting tube 18.

Figure 4:
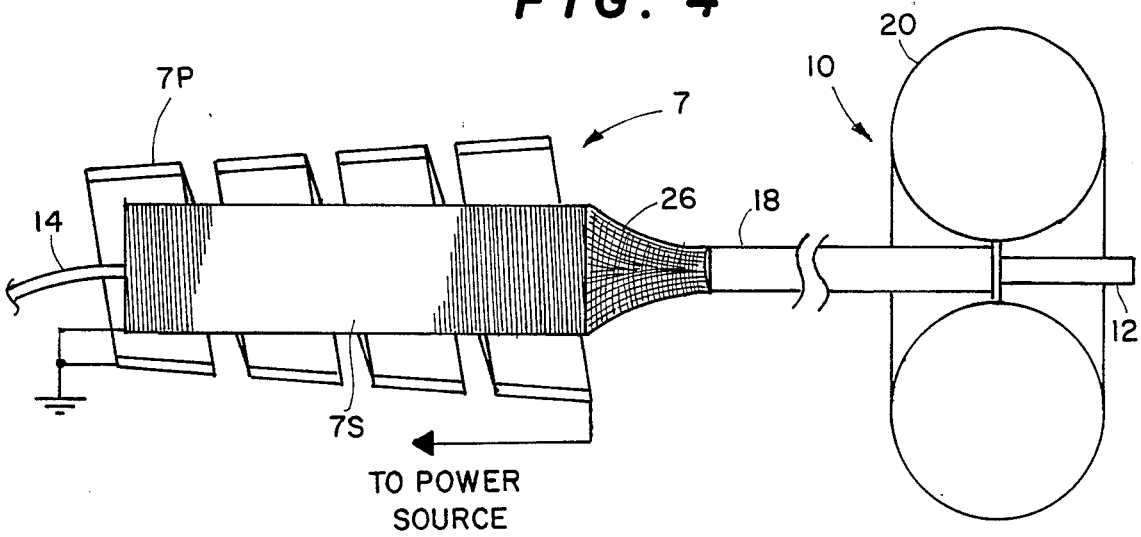
FIG. 4 is a simplified diagram of a Tesla transformer connected to the gun of FIG. 3.

FIG. 4 is a simplified diagram of electron gun 10 connected to Tesla transformer 7 with primary winding 7P shown in cross section for clarity. Primary winding 7P and secondary winding 7S each have an earth grounded end. The ungrounded end of secondary winding 7S has a woven conductor 26 attached to connection tube 18 of gun 10. The woven conductor greatly reduces eddy currents. The Tesla transformer represents a grounded quarter-wave oscillator such that the highest potential developed in the system occurs at the electron beam gun 10. The gas supply hose 14 passes through connection tube 18 and the axis of secondary winding 7S to the gas supply.

Having described the elements of the electron beam gun system of the invention, the operation thereof will be explained with reference to FIGS. 3–6. A source of high molecular weight gas, such as argon, nitrogen or the like is connected to gas tube 14. The gas pressure is adjusted experimentally as discussed below; a pressure of about 120 psi is typically suitable. The flow of gas, as indicated in FIG. 6, enters ceramic tube 12 flowing through convergent-divergent annular venturi 16 at a suitable stagnation pressure. The gas accelerates smoothly and reaches the speed of sound at the venturi throat. As the gas enters into the divergent section, it continues to accelerate, producing a supersonic annular jet, and establishing a vacuous gas region 22 adjacent cathode face 17. Thus, the supersonic annular jet acts as an ejector pump for gas adjacent cathode face 17. The stagnate gas in the wake of the cathode electrode 15 is entrained and evacuated by virtue of the large shear gradient between the stagnate wake and the supersonic jet.

Adjustment of the gas pressure may be made with the aid of vacuum gage 26 connected to passage 24 as shown in FIG. 6. If the stagnation pressure is too low, the gas will not possess sufficient energy to go supersonic. Too high a drive pressure will cause the annular jet to collapse, destroying the vacuous space. Monitoring of the vacuum permits accurate gas pressure adjustment. With the disclosed gases, absolute pressures less than 100 microns of mercury have been generated.

Cathode electrode 15 and ceramic tube 12 undergo intense cooling from the supersonic jet. The convection heat transfer coefficient is large owing to the high flow velocity. When the heat of compression is removed from the supplied gas, static jet temperatures lower than −100° F. are achievable. Low static temperature also improves the efficiency of vacuum generation.

Figure 5:
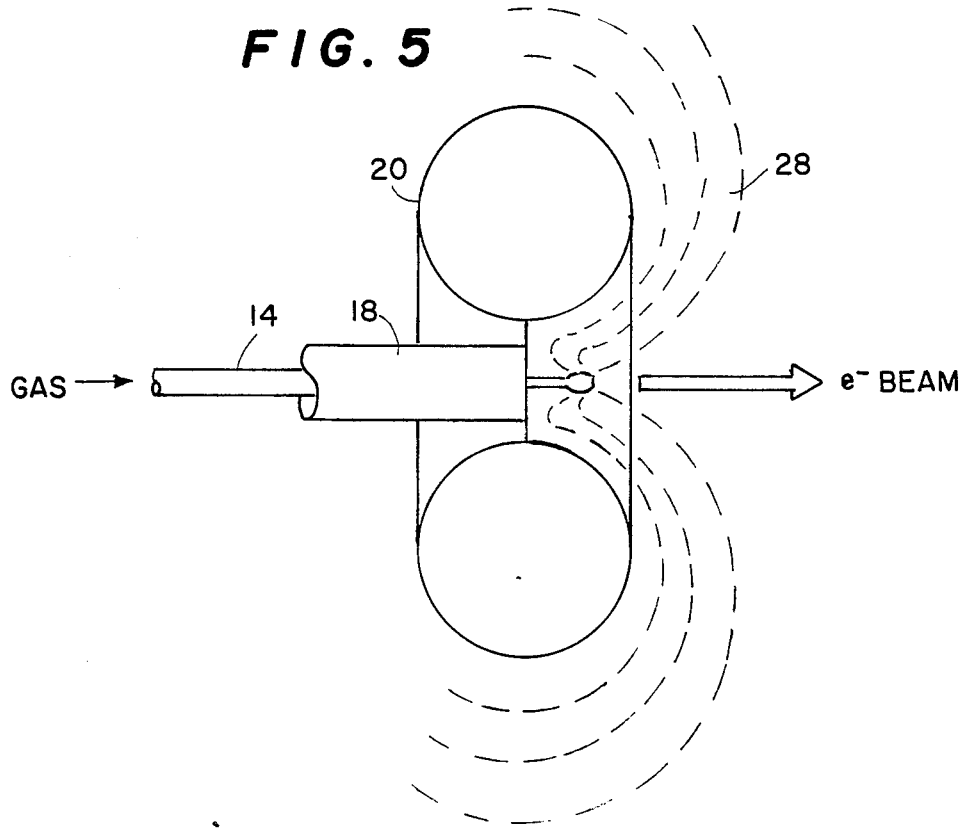
FIG. 5 is an electric field plot of the torus of FIG. 3.

After vacuous space 22 is achieved, the Tesla transformer 7 is energized. Upon the application of each electric surge, torus 20 and cathode face 17 are driven to a negative potential V, which may be on the order of 1.5 megavolts. Due to the intense electric field on cathode face 17, cold field emission of electrons occurs. A negative electric field 28 is set up around torus 20 as shown in FIG. 5 causing torus 20 to act as an electrostatic insulator, directing the emitted electrons in the direction of the arrow. The beam is accelerated by the electric field of the cathode. The electrons obtain relativistic velocities because the energy gained in transit through vacuous region 22 is not dissipated by numerous collisions with gas molecules. The electrons are then emitted into the open air with energy eV.

ALTERNATIVE CATHODE DESIGN

Referring to FIG. 7, a cross sectional view of an alternative cathode design of the electron beam gun of the invention is shown. An aerodynamic body 30 is formed of ceramic having a low dielectric constant. A cathode electrode 34 is hermetically bonded along the longitudinal axis of the body 30 and includes a sharp spike at its distal end. The proximal end is attached to torus web 11, supporting aerodynamic body 30 symmetrically in ceramic tube 12. An auxiliary vacuum duct 32 between cathode electrode 34 and vacuous space 22 serves to supplement and increase the axial length of the overall vacuous space to permit additional acceleration of the electron beam before entering the atmosphere.

Although specific implementations of the invention have been disclosed, these are for exemplary purposes only. Various modifications may be made without departing from the spirit and scope of the invention.

I claim:

1. An electron beam gun comprising:

(a) a very high voltage source;

(b) a non-conductive cylindrical tube having a proximal end and a distal end;

(c) means disposed within said nonconductive tube for forming an annular venturi, said means having an emissive surface, said emissive surface electrically connected to said high voltage source;

(d) means for injecting a high molecular weight gas into the proximal end of said tube to enter said annular venturi at a stagnation pressure to produce supersonic flow in said tube, said supersonic flow producing a vacuum adjacent said emissive surface;

(e) means for periodically enabling said very high voltage source to produce a very high negative potential at said emissive surface sufficient to produce high field emission of electrons therefrom; and (f) electrostatic focusing means for forming said emitted electrons into a beam along the axis of said tube, said beam issuing from said distal end of said tube.

2. The gun as recited in claim 1 in which said very high voltage source is a Tesla transformer system including a transformer having a primary winding, a secondary winding, and a ground connection to said primary and secondary windings.

3. The gun as recited in claim 2 in which said very high voltage source enabling means includes:

a source of pulsating high voltage direct current;

a charging network having an inductor and capacitor connected to said direct current source for storing energy therefrom; and a spark gap switch connected between said charging network and said primary winding, said spark gap switch periodically discharging said stored energy into said transformer to thereby produce said very high negative potential.

4. The gun as recited in claim 1 in which said electrostatic focusing means includes a metallic torus, said tube disposed within a central opening of said torus and concentric with the axis thereof, said torus electrically connected to said emissive surface.

5. The gun as recited in claim 1 in which said tube is ceramic.

6. The gun as recited in claim 1 in which said venturi forming means includes:

a conductive aerodynamic body forming a surface of revolution centered axially in said tube; and said emissive surface is a flat face of said body, transverse to said tube and facing said distal end of said tube.

7. The gun as recited in claim 1 in said venturi forming means includes:

a nonconductive aerodynamic body forming a surface of revolution and having a flared concentric opening at a distal end thereof, said body centered axially in said tube; and said emissive surface is formed by a conductive rod disposed concentrically along said body, said rod having a sharpened distal end thereof extending toward said flared opening.

8. An electron beam gun driven by a very high voltage source comprising:

a conductive torus having a central opening;

a ceramic tube disposed along an axis perpendicular to the plane of said torus and through said central opening;

a conductive tube disposed along said axis connected to a proximal end of said ceramic tube;

a gas hose concentric with said conductive tube and having a proximal end in communication with said ceramic tube at its said proximal end;

a conductive aerodynamic body centered in said ceramic tube to form a convergent-divergent annular venturi, said body having a surface facing a distal end of said ceramic tube, said surface forming an electron emitting cathode, said body electrically connected to said torus and said conductive tube;

a source of high molecular weight gas connected to a distal end of said gas hose, said gas entering said annular venturi at a stagnation pressure to thereby achieve supersonic gas flow in said ceramic tube, said supersonic gas flow producing a vacuum in a region of said ceramic tube adjacent said cathode electrode; and said very high voltage source connected to said conductive tube to drive said torus and said cathode electrode highly negative thereby causing high field emission of an electron beam therefrom, wherein an electric field from said torus maintains said beam along said torus axis.

* * * * *